US012043296B2

(12) United States Patent
Harrysson et al.

(10) Patent No.: US 12,043,296 B2
(45) Date of Patent: Jul. 23, 2024

(54) TRAIN COUPLER ARRANGEMENT WITH AXIAL EXPANSION MODULE

(71) Applicant: DELLNER COUPLERS AB, Falun (SE)

(72) Inventors: Fredrik Harrysson, Gustafs (SE); Anders Westman, Stockholm (SE)

(73) Assignee: DELLNER COUPLERS AB, Falun (SE)

( * ) Notice: Subject to any disclaimer, the term of this patent is extended or adjusted under 35 U.S.C. 154(b) by 891 days.

(21) Appl. No.: 16/973,226

(22) PCT Filed: Jun. 12, 2019

(86) PCT No.: PCT/SE2019/050555

§ 371 (c)(1),
(2) Date: Dec. 8, 2020

(87) PCT Pub. No.: WO2019/240660

PCT Pub. Date: Dec. 19, 2019

(65) Prior Publication Data

US 2021/0253146 A1 Aug. 19, 2021

(30) Foreign Application Priority Data

Jun. 14, 2018 (IN) ..... 201811022339
Jun. 14, 2018 (SE) ..... 1850730-1

(51) Int. Cl.

| | |
|---|---|
| ***B61G 9/22*** | (2006.01) |
| ***B61G 1/22*** | (2006.01) |
| ***B61G 1/28*** | (2006.01) |
| ***B61G 7/14*** | (2006.01) |
| ***B61G 9/06*** | (2006.01) |
| ***B61G 9/20*** | (2006.01) |

(52) U.S. Cl.
CPC ..... *B61G 9/22* (2013.01); *B61G 1/22* (2013.01); *B61G 1/28* (2013.01); *B61G 7/14* (2013.01); *B61G 9/06* (2013.01); *B61G 9/20* (2013.01)

(58) Field of Classification Search
CPC ... B61G 9/22; B61G 9/06; B61G 9/20; B61G 7/14; B61G 1/22; B61G 1/28
USPC ..... 213/188
See application file for complete search history.

(56) References Cited

U.S. PATENT DOCUMENTS 2,402,146 A * 6/1946 Cardwell ..... B61G 9/04 213/32 R
3,810,552 A * 5/1974 Girard ..... B61G 9/22 213/54

(Continued)

FOREIGN PATENT DOCUMENTS

CN 104527707 A 4/2015
WO 2005/102810 A1 11/2005

*Primary Examiner* — S. Joseph Morano
*Assistant Examiner* — James William Jones
(74) *Attorney, Agent, or Firm* — Dilworth & Barrese, LLP

(57) ABSTRACT

The present invention relates to a train coupler adapted for energy absorption by the use of a deformation unit. According to the invention an axial expansion module is provided and mounted together with the deformation unit and an anchor in the housing of the train coupler. By expanding the axial expansion module after being mounted into the housing, the deformation unit and the anchor will be biased between the front and rear lugs of the housing and held in place by a predetermined force in the axial direction only.

5 Claims, 4 Drawing Sheets

(56) References Cited

U.S. PATENT DOCUMENTS

| | | | | | |
|---|---|---|---|---|---|
| 3,913,747 | A | | 10/1975 | Crummett | |
| 4,296,868 | A | * | 10/1981 | Housman | B61G 11/04 213/50 |
| 5,263,351 | A | * | 11/1993 | Berg, III | B21C 3/16 403/374.3 |
| 5,452,529 | A | | 9/1995 | Neuenfeldt et al. | |
| 5,979,679 | A | * | 11/1999 | Ring | B61G 7/10 213/50 |
| 6,024,233 | A | * | 2/2000 | Natschke | B61G 7/10 213/50 |
| 6,073,787 | A | | 7/2000 | Daughterty, Jr. et al. | |
| 2007/0125739 | A1 | * | 6/2007 | Hogbring | B61G 9/24 213/75 R |
| 2007/0151941 | A1 | * | 7/2007 | Forbes | B61G 9/24 213/75 R |
| 2008/0011700 | A1 | * | 1/2008 | Brough | B61G 9/24 213/75 R |
| 2012/0082528 | A1 | | 4/2012 | Wang | |
| 2013/0270210 | A1 | | 10/2013 | Kukulski et al. | |

* cited by examiner

TRAIN COUPLER ARRANGEMENT WITH AXIAL EXPANSION MODULE

FIELD OF THE INVENTION

The present invention relates to a train coupler adapted for energy absorption by the use of a deformation unit. In particular the invention relates to means that facilitates a convenient assembling of parts of the train coupler and which holds the parts of the train coupler securely in place during normal operation.

BACKGROUND OF THE INVENTION

Many existing train couplers comprise parts that are meant to absorb energy upon both minor and larger crashes. The purpose is to direct the forces to the specifically designed units in order to spare other parts of the train set and thereby increase safety for passengers and operators, as well as reducing costs for repair at least after a minor impact. A crash protection system relating to the train coupler may include both parts that could damp the force of an impact in a reversible way, for example rubber elements and hydraulic elements, and non-reversible energy absorbers such as a deformation unit. Typically the reversible elements are able of absorbing less energy than the non-reversible element. The different energy absorbing parts can be seen as acting during different stages during an impact with the aim that the coupler should never bottom out. Deformation units in the form of deformation tubes are describe in WO2005075272 and WO2015180839 and are offered commercially and are in widespread use. Such deformation tubes are a highly robust and efficient energy absorption component. The energy is absorbed by expanding (or collapsing) a tube over a mandrel, creating a very repeatable structural plastic deformation, that together with the friction determines the deformation force. The start force of the deformation tube is important when combined with a release function, so that the sequence is always maintained within the scope of the design.

The deformation unit is typically mounted in series with an anchor or bracket in a housing fixed to the car underframe. The anchor is connected to a bar which via further couplings means, such as a coupler head, may connect to the coupler of another car. The housing is provided with a pair of front lugs and a pair of rear lugs, wherein the front lugs interact with the anchor during forward motion and the rear lugs interact with the deformation unit to receive forces in the opposite direction. The anchor and the deformation unit are provided in-between the front and rear lugs, possibly also with other parts.

In order to ensure the functionality of the train coupler, especially with regards to the energy absorption functionality in case of a crash of the deformation unit as indicated above, it is of vital importance that the anchor and deformation unit are biased in-between the front and rear lugs. The force should typically be in the order of 600-1000 kN, and will be referred to as a locking force.

The anchor and the deformation unit are typically mounted from underneath the car into the housing which is at least partly open on underside. The housing is then closed with a cover plate or the like. The design of the housing, for example the distance between the front and rear lugs, may vary so that a space or a compartment is formed in-between the anchor and the deformation unit and/or in between the anchor and the front lugs or the deformation unit and the rear lugs, respectively. In addition manufacturing tolerances causes a slight variation of size of the compartment and also a possible variation from one side to the other.

US2007125739 describes the use of a pair of interconnected wedges driven in after the anchor to provide a suitable locking force. A locking force is provided in the axial direction of the coupler, but additionally a force will be present in the transverse direction and exerted on the car underframe by the interconnected wedges. Slight variations in distance between the front and rear lugs on two sides of the housing may be accounted for by the interconnect of the interconnected wedges being somewhat flexible, so that one side can be driven up a distance farther than the other. However this adaption is difficult to control. A further disadvantage is that the wedges as well as other parts may fall down on the tracks after an impact.

SUMMARY OF THE INVENTION

The object of the invention is to provide a train coupler that overcomes the drawback of prior art train coupler. In particular it is an object to provide a train coupler wherein a locking force holding at least an anchor and a deformation unit in place in a controllable and reliable way and which is adjustable from outside of the housing of the train coupler.

This is achieved by the train coupler as defined herein.

The train coupler according to the invention comprises a bar which at a front end is adapted to engage with coupling means and at a rear end attached to an anchor. The longitudinal extension of the bar in a relaxed position defines an axial direction and a the centre of the bar a central axis of the train coupler. The anchor is arranged to interact with a deformation unit positioned coaxially with the anchor and after the anchor in the axial direction from the bar. The anchor and the deformation unit are comprised in an housing in-between a pair of front lugs and a pair of rear lugs. At least one axial expansion module is inserted in-between the front lugs and the anchor or in-between the anchor and the deformation unit or in-between the deformation unit and the rear lugs. The axial expansion module is arranged to be expandable in the axial direction and to be expanded after having been inserted into the housing. In the expanded state the axial expansion module exerts a predetermined force on the deformation unit and the anchor so that the axial expansion module, the deformation unit and the anchor are held between the front lugs and the rear lugs. The axial expansion module, the deformation unit and the anchor can be seen as biased between the front lugs and the rear lugs.

According to one embodiment of the invention the train coupler is provided with two axial expansion modules arranged on each side of the centre axis. Preferably the two axial expansion modules are arranged with adjusting means being accessible from underneath the train coupler, which is also the side from this the anchor and deformation unit is normally mounted in the housing.

According to one aspect of the invention the axial expansion module is a wedge assembly comprising at least three separate pieces wherein at least two of the three separate pieces are wedged pieces having parallel wedged surfaces facing each other. The axial expansion is provided by moving the at least the two wedged pieces relative each other in a transversal direction to the central axis.

According to one embodiment of the invention the axial expansion module is a wedge assembly comprising a first wedged piece with a first wedged surface and a second wedged piece with a second wedged surface wherein the first and second wedged surfaces are parallel and facing each other. The first wedged piece provided with a threaded hole provided on its bottom surface. The wedge assembly comprises a third piece with a non-wedged surface which faces the non-wedged surface of the first wedged piece and a fixture provided in contact with the bottom surfaces of the second wedged piece and the third piece and extending at least partly over the respective bottom surfaces. The fixture is provided with a through hole. A bolt extends through the hole of the fixture and engages with the threaded hole of the first wedged piece and the head of the bolt acts on the fixture.

According to one embodiment of the invention the axial expansion module is a wedge assembly comprising a first wedged piece with two wedged surfaces, a second wedged piece with one wedged surface facing one of the wedged surfaces of the first wedged piece and a third wedged piece with one wedged surface facing the other of the wedged surfaces of the first wedged piece. The first wedged piece is provided with a threaded hole provided on its bottom surface. A fixture is provided in contact with the bottom surfaces of the second wedged piece and the third wedged piece and extending at least partly over the respective bottom surfaces. The fixture is provided with a through hole. A bolt (37*d*) extends through the hole of the fixture and engages with the threaded hole of the first wedged piece and the head of the bolt acts on the fixture.

According to one embodiment of the invention the axial expansion module is a wedge assembly comprising a first wedged piece with two wedged surfaces, a second wedged piece with one wedged surface facing one of the wedged surfaces of the first wedged piece, and a third wedged piece with one wedged surface facing the other of the wedged surfaces of the first wedged piece. The first wedged piece is provided with a through hole extending from its bottom surface to its top surface. A fixture is provided in contact with the top surfaces of the second wedged piece and the third wedged piece and extending at least partly over the respective top surfaces. The fixture is provided with a threaded hole. A bolt extends through the hole of the first wedged piece and engages with the threaded hole of the fixture and the head of the bolt acts on the bottom surface of the first wedged piece.

According to one embodiment of the invention the axial expansion module is a wedge assembly comprising a first wedged piece with a rear facing wedged surface and a front facing wedged surface, a second wedged piece with a rear facing wedged surfaces and a front facing wedged surface, a third wedged piece with an upper and an lower rear facing wedged surfaces, and a fourth wedged piece with an upper and a lower front facing wedged surfaces. The first wedged piece is provided above the second wedged piece in a direction transverse to the centre axis. The upper and lower wedged surfaces of the third and fourth wedged pieces are arranged so that wedged pieces have a larger thickness in the axial direction in the middle of the wedged pieces than at the intersection with the top and bottom surfaces. The rear facing wedged surface of the first wedged piece faces and corresponds to the upper front facing wedged surface of the fourth wedged piece and the front facing wedged surface of the first wedged piece faces and corresponds to the upper rear facing wedged surface of the third wedged piece. The rear facing wedged surface of the second wedged piece faces and corresponds to the lower front facing wedged surface of the fourth wedged piece and the front facing wedged surface of the first wedged piece faces and corresponds to the lower rear facing wedged surface of the third wedged piece. The first wedged piece is provided with a threaded hole on its bottom surface and the second wedged piece is provided with a through hole extending from its bottom surface to its top surface. A bolt extends through the through hole of the second wedged piece and engages with the threaded hole of the first wedged piece and the bolt head acts on the bottom surface of the second wedged piece.

Thanks to the invention mounting and maintenance of the train coupler is simplified. Since the anchor, the deformation unit and the axial expansion module are held in place by a force in the axial direction only no forces transverse forces are exerted to the housing or other parts.

One advantage of the present invention is that slight variations in the distances between one pair of front and rear lugs compared to the other pair of front and rear lugs can easily be compensated for by using two axial expansion modules, one on each side, and adjusting them independently.

A further advantage is that the housing can be provided with a removable cover plate that hinders the axial expansion module(s) to fall down on the track after an impact.

DETAILED DESCRIPTION

Figure 1:
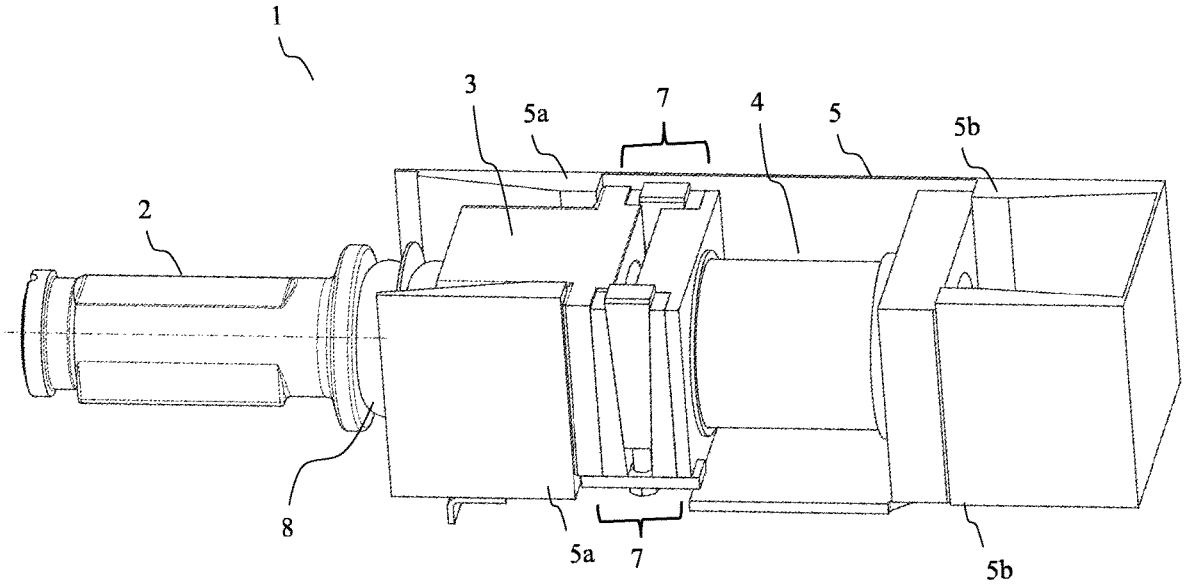
FIG. 1 is a perspective schematic view of the train coupler according to the invention.

Terms such as "top", "bottom", upper", lower", "below", "above", "front", "back", "in front", "behind" etc are used merely with reference to the geometry of the embodiment of the invention shown in the drawings and/or during normal operation of the device and are not intended to limit the invention in any manner. In the following the term "corresponding surfaces" is used to describe two wedged surfaces that are designed to interact and which two surfaces are parallel during operation.

FIG. 1 schematically illustrates the train coupler 1 according to the invention in an perspective view. Some parts have been omitted in order to better illustrate the novel parts. The train coupler 1 is mounted to an underframe of a train car.

The train coupler 1 comprises a bar 2, which at a front end is provided with coupling means (not shown) for example a coupler head and at a rear end attached to an anchor 3. The bar 2 may typically interact with the anchor 3 via a plurality of ring-shaped elastic elements 8 of which one can be seen in the figure. The design of the bar 2 and the anchor 3 and its interaction follows well established design principles known in the art. The anchor 3 is together with a deformation unit 4 comprised in a housing 5. Preferably the housing covers at least the major portion of three sides of the train coupler 1. The fourth side is at least partly open. One or more removable cover plates (not shown) may cover the open side of the housing 5. Typically installation and maintenance of the parts in the housing is done from underneath and hence the at least partly open side of the housing should be the bottom side of the housing. I.e. the side facing the ground during normal operation of the train. The longitudinal extension of the bar 2 can be seen as in its starting position defining an axial direction and a central axis of the train coupler 1, in the figure indicated with a dashed line.

The housing 5 is provided with a pair of front lugs 5*a* and a pair of rear lugs 5*b*. Each pair of lugs is arranged symmetrically with regards to the central axis and typically with the opening them between accessible from the open side of the housing, i.e. typically the bottom side. The anchor 3 and the deformation unit 4 are provided in-between the front lugs 5*a* and the rear lugs 5*b* and aligned with regards to the central axis. The deformation unit 4 is placed after the anchor in the axial direction from the bar 2.

A pair of axial expansion modules 7 is provided either in-between the deformation unit 4 and the anchor 3, in between the anchor 3 and the front lugs 5*a* or in-between the deformation unit 4 and the rear lugs 5*b*. Alternatively only one axial expansion module 7 is provided in-between the anchor 3 and the deformation unit 4 and centralized in at least one direction with regards to the central axis. In an embodiment utilizing only one axial expansion module 7, the expansion module 7 should preferably be extended over at least one third of the plane of the anchor 3 facing the deformation unit 4 in order to provide mechanical stability. The deformation unit 4 typically comprises a cylinder that moves rearwards upon an impact. If the axial expansion module/modules 7 are placed in-between the deformation unit 4 and the rear lugs 5*b*, care must therefore be taken so that the cylinder can move freely without contact with the axial expansion module 7. If only one axial expansion module 7 is used it is preferably provided with an opening for receiving the cylinder of the deformation unit 4, the opening with a margin larger than the diameter of the cylinder. The axial expansion module 7 is arranged to be expandable in the axial direction and thereby exert a force in the axial direction, the locking force that bias the anchor 3 and the deformation unit 4 and holds the parts in place in the housing 5. The force is typically predetermined and applied from outside the housing 5 after mounting the anchor 3, the deformation unit 4 and the axial expansion module 7 in-between the front 5*a* and rear lugs 5*b*. The axial expansion module 7 is further arranged to maintain the force or bias.

According to the train coupler of the invention at least the deformation unit 4 the anchor 3 and the axial expansion unit 7 are held in place by the locking force only, i.e. the force originating from the axial expansion module 7 being expanded in the axial direction. A contact may still exist between for example the axial expansion module 7 and the housing 5 or cover plates. However this does not constitute a load bearing contact, at least not if compared to the locking force, and if the cover plate is removed, the parts of the train coupler are still held in place by the locking force. The axial expansion of the axial expansion module 7 should be adjustable from outside the housing 5, so that the axial expansion module 7 could be mounted into the housing 5 in a contracted state at one of the positions in-between the deformation unit 4 and the anchor 3, in between the anchor 3 and the front lugs 5*a* or in-between the deformation unit 4 and the rear lugs 5*b* and after mounting expanded to provide the locking force. Hence the axial expansion of the axial expansion module 7 is provided by relative motion of only parts within the axial expansion module 7. In the same manner forces required for the expansion in the axial direction, i.e. forces not in the axial direction of the train coupler, are taken up within the axial expansion module 7. Thereby the axial expansion is provided without for example a wedge acting against the housing 5 or the underframe as in prior art solutions.

The forces upon a crash impact on the axial expansion module 7 may be significant and the mechanical stability of the part much be maintained in order to direct the forces to the energy absorbing parts in a controlled manner.

Figure 2:
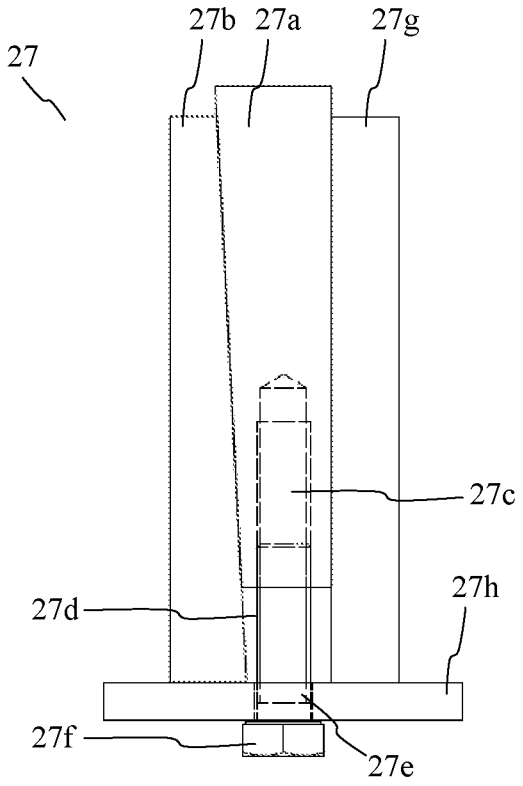
FIG. 2 is a schematic illustration in side view of one embodiment of the axial expansion module being part of the train coupler according to the invention.

According to one embodiment of the invention, schematically illustrated in FIG. 2, the axial expansion module 27 comprises a first wedged piece 27*a* with a first wedged surface and a second wedged piece 27*b* with a second wedged surface and the wedged surfaces are parallel and facing each other. A third piece 27*g* faces the non-wedged surface of the first wedged piece 27*a*. A fixture 27*h* is provided in contact with the bottom surfaces of the second wedged piece 27*b* and the third piece 27*g* and extending at least partly over the respective surfaces. The fixture 27*h* may be fixed to one of the second wedged piece 27*b* and the third piece 27*g*. In the mounted position the wedged surfaces forms planes that are perpendicular to the central axis of the train coupler 1 and have normals that deviates from the central axis. The outer surfaces of the wedge assembly 27 have normals that will be in the direction of central axis. The first wedged piece 27*a* is provided with a threaded hole 27*c* for receiving a bolt 27*d*. The bolt 27*d* extends through a hole 27*e* in the fixture 27*h* and the head 27*f* of the bolt 27*d* acts on the fixture 27*h*.

By tightening the bolt 27*d*, which is readily done from outside the housing 5, the bolt head 27*f* acts on the fixture 27*h* and forces the first wedged piece 27*a* downwards and an expansion is provided in the axial direction providing the locking force. The expansion and hence force in the axial direction is provided without transversal motion of the outer pieces, the second wedged piece 27*b* and the third piece 27*g*. Thereby no transversal forces are exerted on the anchor 3 or the deformation unit 4 during mounting and there will be no risk of misplacement of the anchor 3 or the deformation unit 4, minimizing the risks for misalignment or the set up being skewed. The arrangement with the outer pieces of the wedge assembly 7 which are in contact with the anchor 3, the deformation unit 4 or the lugs 5*a/b*, not moving in any direction but the axial direction is a common feature for all embodiments of the invention.

As realized by the skilled person, the bolt and threaded hole arrangement can be altered in various ways and provide the same functionality. For example, the bolt 27*d* may be replaced with a threaded pin fastened to the first wedged piece 27*a* and extending through the second wedged piece 27*b*. A nut mating with the bolt 27*d* and acting on the bottom surface provides for the relative motion of the first 27*a* and second 27*b* wedged surfaces. Also in the other embodiments of the invention the bolt arrangement can be varied in this manner.

Figure 3:
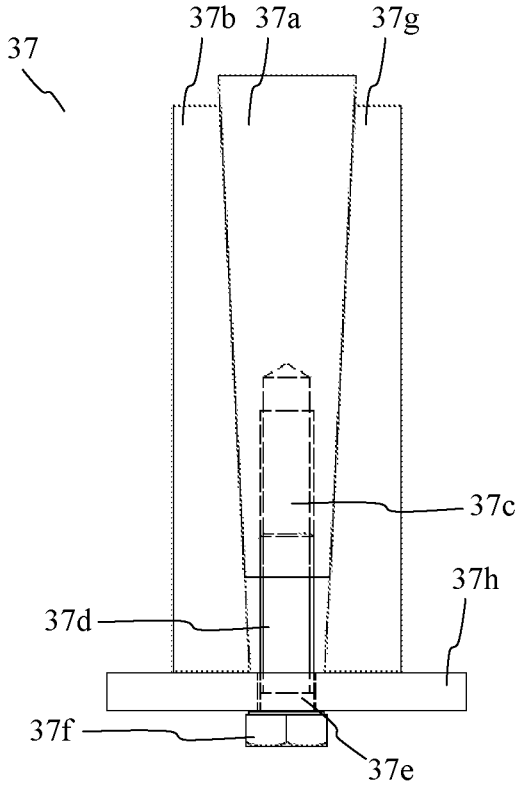
FIG. 3 is a schematic illustration in side view of one embodiment of the axial expansion module being part of the train coupler according to the invention.

According to one embodiment of the invention, schematically illustrated in FIG. 3, the axial expansion module comprises a first wedged piece 37*a* with two wedged surfaces, a second wedged piece 37*b* with a one wedged surface facing one of the wedged surfaces of the first wedged piece 37*a*, and a third wedged piece 37*g* with one wedged surface facing the other of the wedged surfaces of the first wedged piece 37*a*. A fixture 37*h* is provided in contact with the bottom surfaces of the second wedged piece 37*b* and the third wedged piece 37*g* and extending at least partly over the respective surfaces. The fixture 37*h* may be fixed to one of the second wedged piece 37*b* and the third wedged piece 37*g*. In the mounted position the wedged surfaces forms planes that are perpendicular to the central axis of the train coupler 1 and have normals that deviates from the central axis. The outer surfaces of the wedge assembly 37 have normals that will be in the direction of central axis. The first wedged piece 37*a* is provided with a threaded hole 37*c* for receiving a bolt 37*d*. The bolt 37*d* extends through a hole 37*e* in the fixture 37*h* and the head 37*f* of the bolt 37*d* acts on the fixture 37*h*. By tightening the bolt 37*d*, which is readily done from outside the housing 5, the bolt head 37*f* acts on the fixture 37*h* and forces the first wedged piece 37*a* downwards and the second wedged piece 47*b* and the third wedged piece 47*g* outwards in the axial direction the locking force is provided. The expansion and hence force in the axial direction is provided without transversal motion of the second wedged piece 37*b* and the third wedged piece 37*g*.

Figure 4:
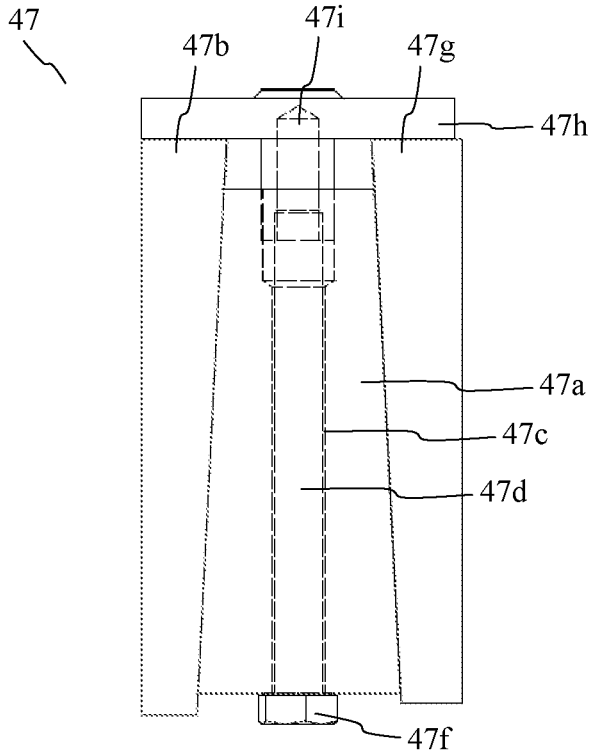
FIG. 4 is a schematic illustration in side view of one embodiment of the axial expansion module being part of the train coupler according to the invention.

According to one embodiment of the invention, schematically illustrated in FIG. 4, the axial expansion module comprises a first wedged piece 47*a* with two wedged surfaces, a second wedged piece 47*b* with a one wedged surface facing one of the wedged surfaces of the first wedged piece 47*a*, and a third wedged piece 47*g* with one wedged surface facing the other of the wedged surfaces of the first wedged piece 47*a*. A fixture 47*h* is provided in contact with the top surfaces of the second wedged piece 47*b* and the third wedged piece 47*g* and extending at least partly over the respective surfaces. The fixture 47*h* may be fixed to one of the second wedged piece 47*b* and the third wedged piece 47*g*. The fixture 47*h* is provided with a threaded hole 47*i* for receiving a bolt 47*d*. In the mounted position the wedged surfaces forms planes that are perpendicular to the central axis of the train coupler 1 and have normals that deviates from the central axis. The first wedged piece 47*a* is provided with a through hole 47*c* for receiving a bolt 47*d*. The bolt 47*d* extends through the hole 47*c* in the first wedged piece 47*a* and mates with the threaded hole 47*i* in the fixture 47*h*. The head 47*f* of the bolt 47*d* acts on the surface of the first wedged piece 47*a* facing the open side of the housing, typically the bottom surface. The expansion and hence the force in the axial direction will be provided similarly as to the previous embodiment described with references to FIG. 3.

Figure 5:
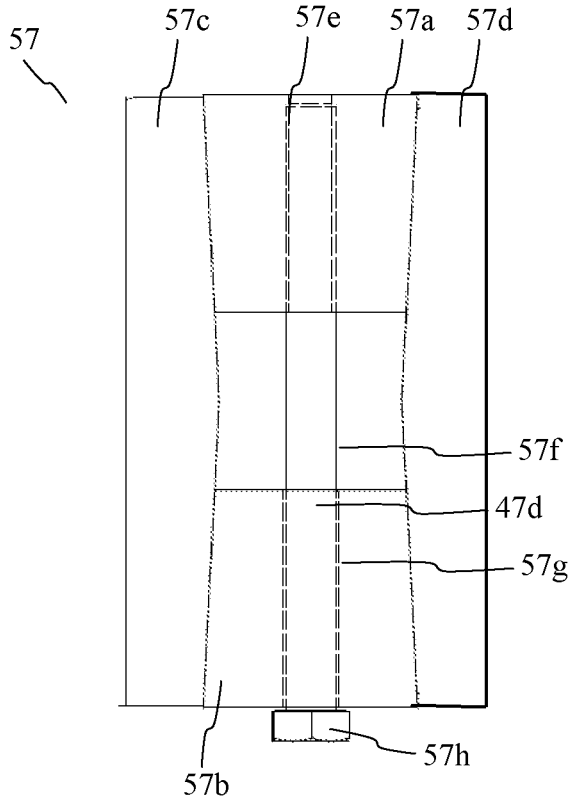
FIG. 5 is schematic illustrations in side view of one embodiment of the axial expansion module being part of the train coupler according to the invention.

According to one embodiment of the invention, schematically illustrated in FIG. 5, the axial expansion module comprises a first wedged piece 57*a* with a rear facing wedged surfaces and a front facing wedged surface, a second wedged piece 57*b* with a rear facing wedged surfaces and a front facing wedged surface, a third wedged piece 57*c* with an upper and an lower rear facing wedged surfaces, and a fourth wedged piece 57*d* with an upper and a lower front facing wedged surfaces. The upper and lower wedged surfaces of the third 57*c* and fourth 57*d* wedged pieces are arranged so that wedged pieces have a larger thickness in the axial direction in the middle of the wedged pieces than at the intersection with the top and bottom surfaces. Intersections are formed between the respective upper and lower wedged surfaces forming a line that is perpendicular to the central axis. The upper wedged surface of the third wedged piece 57*c* is parallel to the lower wedged surface of the fourth wedged piece 57*d* and the lower wedged surface of the third wedged piece 57*c* is parallel to the upper wedged surface of the fourth wedged piece 57*d*. In the mounted position the wedged surfaces forms planes that are perpendicular to the central axis of the train coupler 1 and have normals that deviates from the central axis. The rear facing wedged surface of the first wedged piece 57*a* faces and corresponds to the upper front facing wedged surface of the fourth wedged piece 57*d* and the front facing wedged surface of the first wedged piece faces and corresponds to the upper rear facing wedged surface of the third wedged piece 57*d*. Equivalently the rear facing wedged surface of the second wedged piece 57*b* faces and corresponds to the lower front facing wedged surface of the fourth wedged piece 57*d* and the front facing wedged surface of the first wedged piece faces and corresponds to the lower rear facing wedged surface of the third wedged piece 57*c*. The first wedged piece 57*a* is provided with a threaded hole 57*e* for receiving a bolt 57*f*. The second wedged piece 57*b* is provided with a through hole 57*g* for receiving the bolt 57*f*, the bolt head 57*h* acting on the bottom surface of the second wedged piece 57*b*. By tightening the bolt 57*f*, the bolt head 57*h* accessible from outside the housing 5, the first 57*a* and second 57*b* wedged pieces will be pushing the third and fourth wedged piece outwards in the axial direction in a symmetrical action.

Figure 6A:
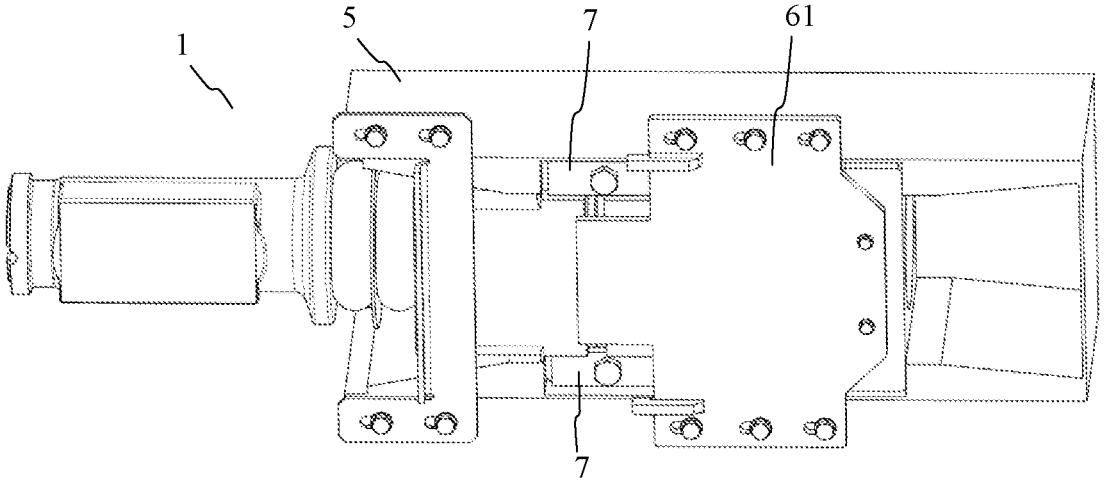
FIG. 6*a-b* are perspective schematic views from underneath of the housing of the train coupler according to the invention.
Figure 6B:
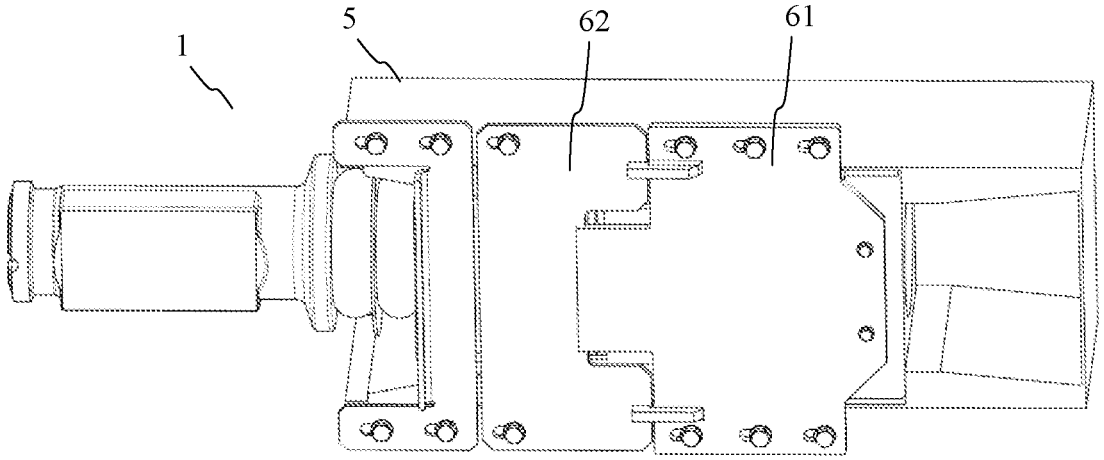

According to one embodiment of the invention, schematically illustrated in FIGS. 6*a*-*b*, the open side of the housing 5, preferably the bottom side, is provided with a first cover plate 61 essentially covering the deformation unit. A removable second cover plate 62 covers the two wedged assemblies 7, here exemplarily depicted as provided between the anchor 3 and the deformation unit 4. FIG. 7*a* illustrates the housing without the second cover plate mounted and 7*b*) the removable second cover plate 62 mounted. The removable second cover plate 62 allows for easy adjustment of the bolts of the wedged assemblies and will prevent the wedged assemblies from falling out on the tracks after an impact. It should be noted that the two wedged assemblies should not be in contact with the removable second cover plate 62 during normal operation.

The exact dimension of the axial expansion module will depend on and will be made to correspond to the dimensions of the train coupler. As a non-limiting example the wedge assembly described with references to FIG. 3 has a width in the axial direction of approximately 100 mm, a thickness of 25 mm, the wedged pieces a height of 250 mm and the assembly a total height of 300 mm. These dimensions refer to a train coupler wherein two wedged assemblies are used. The parts may typically be manufactured from a structural steel such as S355J2G3 (Standard: EN10 027-1). The angle of inclination of the wedged surfaces may preferably be in the interval of 2-7° in relation the non-wedged surfaces, for example the outer surfaces of the wedge assembly.

Apart from the novel axial expansion module all parts of the here described train couple are commercially available and can be considered standard parts. Different markets follow different standards and regulations and the specific designs and appearances of the parts may differ accordingly. Different manufacturers also provide different designs. Given the above teaching a skilled engineer would adapt the axial expansion module to work with the other parts of a train couple without undue burden.

The invention claimed is:

1. A train coupler (1) for coupling of a train car, comprising a bar (2), which at a front end is adapted to engage with coupling means and at a rear end attached to an anchor (3), the longitudinal extension of the bar (2) in a relaxed position defining an axial direction and a central axis of the train coupler (1), wherein the anchor (3) is arranged to interact with a deformation unit (4), the deformation unit (4) positioned coaxially with the anchor (3) and after the anchor (3) in the axial direction from the bar (2), the anchor (3) and the deformation unit (4) comprised in a housing (5) in-between a pair of front lugs (5*a*) and a pair of rear lugs (5*b*), at least one axial expansion module (7) is inserted in-between the front lugs (5*a*) and the anchor (3) or in-between the anchor (3) and the deformation unit (4) or in-between the deformation unit (4) and the rear lugs (5*b*), and the axial expansion module (7) is arranged to be expandable in the axial direction and expanded after having been inserted into the housing (5), the axial expansion module (7) exerting a predetermined force on the deformation unit (4) and the anchor (3) so that the axial expansion module (7), the deformation unit (4) and the anchor (3) are held between the front lugs (5*a*) and the rear lugs (5*b*), the axial expansion module (7) is a wedge assembly comprising:

a first wedged piece (37*a*) with two wedged surfaces, a second wedged piece (37*b*) with one wedged surface facing one of the wedged surfaces of the first wedged piece (37*a*), and a third wedged piece (37*g*) with one wedged surface facing the other of the wedged surfaces of the first wedged piece (37*a*), the first wedged piece (37*a*) provided with a threaded hole (37*c*) provided on its bottom surface;

a fixture (37*h*) provided in contact with the bottom surfaces of the second wedged piece (37*b*) and the third wedged piece (37*g*) and extending at least partly over the respective bottom surfaces, the fixture (37*h*) provided with a hole (37*e*); and a bolt (37*d*) extending through the hole (37*e*) of the fixture (37*h*) and engaging with the threaded hole (37*c*) of the first wedged piece (37*a*) and a head (37*f*) of the bolt (37*d*) acting on the fixture (37*h*).

2. The train coupler (1) according to claim 1, comprising two wedged assemblies (7) provided on each side of the centre axis and their bolt heads facing the underside of the housing.

3. The train coupler (1) according to claim 2, wherein the housing comprises at least one cover plate (61) being open at the position of the wedged assemblies (7) and at least one second cover plate (62) covering at least partly the bottom surfaces of the two wedged assemblies (7).

4. A The train coupler (1) for coupling of a train car, comprising a bar (2), which at a front end is adapted to engage with coupling means and at a rear end attached to an anchor (3), the longitudinal extension of the bar (2) in a relaxed position defining an axial direction and a central axis of the train coupler (1), wherein the anchor (3) is arranged to interact with a deformation unit (4), the deformation unit (4) positioned coaxially with the anchor (3) and after the anchor (3) in the axial direction from the bar (2), the anchor (3) and the deformation unit (4) comprised in a housing (5) in-between a pair of front lugs (5*a*) and a pair of rear lugs (5*b*), at least one axial expansion module (7) is inserted in-between the front lugs (5*a*) and the anchor (3) or in-between the anchor (3) and the deformation unit (4) or in-between the deformation unit (4) and the rear lugs (5*b*), the axial expansion module (7) is arranged to be expandable in the axial direction and expanded after having been inserted into the housing (5), the axial expansion module (7) exerting a predetermined force on the deformation unit (4) and the anchor (3) so that the axial expansion module (7), the deformation unit (4) and the anchor (3) are held between the front lugs (5*a*) and the rear lugs (5*b*), the axial expansion module (7) is a wedge assembly (47) comprising:

a first wedged piece (47*a*) with two wedged surfaces, a second wedged piece (47*b*) with one wedged surface facing one of the wedged surfaces of the first wedged piece (47*a*), and a third wedged piece (47*g*) with one wedged surface facing the other of the wedged surfaces of the first wedged piece (47*a*), the first wedged piece (47*a*) provided with a through hole (47*c*) extending from its bottom surface to its top surface;

a fixture (47*h*) provided in contact with the top surfaces of the second wedged piece (47*b*) and the third wedged piece (47*g*) and extending at least partly over the respective top surfaces, the fixture (47*h*) provided with a threaded hole (47*i*); and a bolt (47*d*) extending through the hole (47*c*) of the first wedged piece (47*a*) and engaging with the threaded hole (47*i*) of the fixture (47*h*) and a head (47*f*) of the bolt (37*d*) acting on the bottom surface of the first wedged piece (47*a*).

5. A train coupler (1) for coupling of a train car, comprising a bar (2), which at a front end is adapted to engage with coupling means and at a rear end attached to an anchor (3), the longitudinal extension of the bar (2) in a relaxed position defining an axial direction and a central axis of the train coupler (1), wherein the anchor (3) is arranged to interact with a deformation unit (4), the deformation unit (4) positioned coaxially with the anchor (3) and after the anchor (3) in the axial direction from the bar (2), the anchor (3) and the deformation unit (4) comprised in a housing (5) in-between a pair of front lugs (5*a*) and a pair of rear lugs (5*b*), at least one axial expansion module (7) is inserted in-between the front lugs (5*a*) and the anchor (3) or in-between the anchor (3) and the deformation unit (4) or in-between the deformation unit (4) and the rear lugs (5*b*), the axial expansion module (7) is arranged to be expandable in the axial direction and expanded after having been inserted into the housing (5), the axial expansion module (7) exerting a predetermined force on the deformation unit (4) and the anchor (3) so that the axial expansion module (7), the deformation unit (4) and the anchor (3) are held between the front lugs (5*a*) and the rear lugs (5*b*), the axial expansion module (7) is a wedge assembly (57) comprising:

a first wedged piece (57*a*) with a rear facing wedged surface and a front facing wedged surface, a second wedged piece (57*b*) with a rear facing wedged surfaces and a front facing wedged surface, the first wedged piece (57*a*) provided above the second wedged piece (57*b*) in a direction transverse to the centre axis, a third wedged piece (57*c*) with an upper and an lower rear facing wedged surfaces, and a fourth wedged piece (57*d*) with an upper and a lower front facing wedged surfaces, the upper and lower wedged surfaces of the third (57*c*) and fourth (57*d*) wedged pieces arranged so that wedged pieces have a larger thickness in the axial direction in the middle of the wedged pieces than at the intersection with the top and bottom surfaces, the rear facing wedged surface of the first wedged piece (57*a*) faces and corresponds to the upper front facing wedged surface of the fourth wedged piece (57*d*), the front facing wedged surface of the first wedged piece (57*a*) faces and corresponds to the upper rear facing wedged surface of the third wedged piece (57*d*), the rear facing wedged surface of the second wedged piece (57*b*) faces and corresponds to the lower front facing wedged surface of the fourth wedged piece (57*d*), the front facing wedged surface of the first wedged piece (57*a*) faces and corresponds to the lower rear facing wedged surface of the third wedged piece (57*c*), the first wedged piece (57*a*) provided with a threaded hole (57*e*) on its bottom surface, the second wedged piece (57*b*) provided with a through hole (57*g*) extending from its bottom surface to its top surface; and a bolt (57*f*) extending through the through hole (57*g*) of the second wedged piece (57*b*) and engaging with the threaded hole (57*e*) of the first wedged piece (75*a*), a bolt head (57*h*) of the bolt (57*f*) acting on the bottom surface of the second wedged piece (57*b*).

* * * * *